United States Patent [19]

Vogtherr et al.

[11] Patent Number: 4,840,426

[45] Date of Patent: Jun. 20, 1989

[54] OFFICE CHAIR

[75] Inventors: Burkhard Vogtherr, Kandern-Holzen; Manfred Elzenbeck, Steinheim/Murr, both of Fed. Rep. of Germany

[73] Assignee: Davis Furniture Industries, Inc., High Point, N.C.

[21] Appl. No.: 102,724

[22] Filed: Sep. 30, 1987

[51] Int. Cl.[4] ..... A47C 3/00

[52] U.S. Cl. ..... 297/300; 297/342

[58] Field of Search ..... 297/303, 320, 321, 342; 248/188.7

[56] References Cited

U.S. PATENT DOCUMENTS

| | | | |
|---|---|---|---|
| 2,303,308 | 11/1942 | McArthur | 297/342 X |
| 3,870,269 | 3/1975 | Werner et al. | 248/421 X |
| 4,169,625 | 10/1979 | Peterson | 248/188.7 |
| 4,412,667 | 11/1983 | Doerner | 248/188.7 |
| 4,451,085 | 5/1984 | Franck et al. | 297/300 |
| 4,537,445 | 8/1985 | Neuhoff | 297/300 |
| 4,579,386 | 4/1986 | Rupp et al. | 297/355 |
| 4,641,885 | 2/1987 | Brauning | 297/300 |

FOREIGN PATENT DOCUMENTS

| | | | |
|---|---|---|---|
| 1301578 | 7/1962 | France | 297/342 |
| 80672 | 8/1953 | Norway | 297/342 |

*Primary Examiner*—Francis K. Zugel

*Attorney, Agent, or Firm*—C. Robert Rhodes; Judith E. Garmon

[57] ABSTRACT

An office chair in which a backrest and seat are articulated together and the resulting assembly pivotally suspended from the rear end of the side arms which form a pivot point positioned at or near the center of gravity of the chair when occupied. The pivot point is fixed in space by an underlying support system. The lower end of the arm rest is affixed to the rear transverse support arm of a support frame which is, in turn, mounted on the upper end of a vertical support column. The front end of the set member is slidably mounted on a forward cross arm of the support frame through a hexagonally-shaped sliding/locking member in such manner that the back rest and seat may be selectively locked in position or released to adjustably recline (backrest) and slide (seat). The articulated connected between the back rest and seat member is positioned beneath and rearwardly of the aforementioned point of pivotal suspension, so that when the back rest is tilted rearwardly from an upright position the rear portion of the seat member is caused to lower slightly as it slides forwardly. All controls for the chair are located on either end of the aforementioned support arm.

12 Claims, 6 Drawing Sheets

FIG. 6
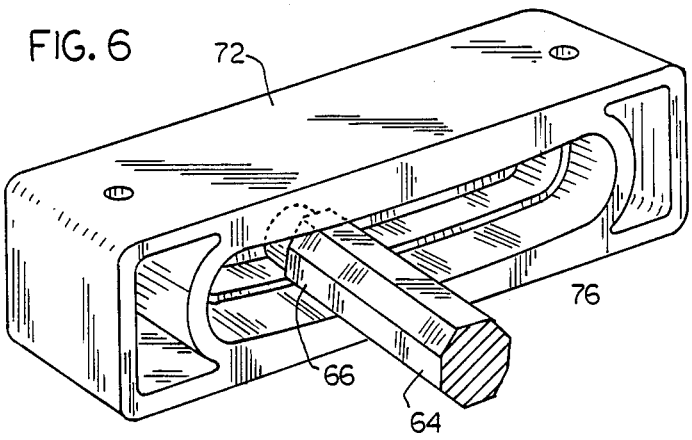
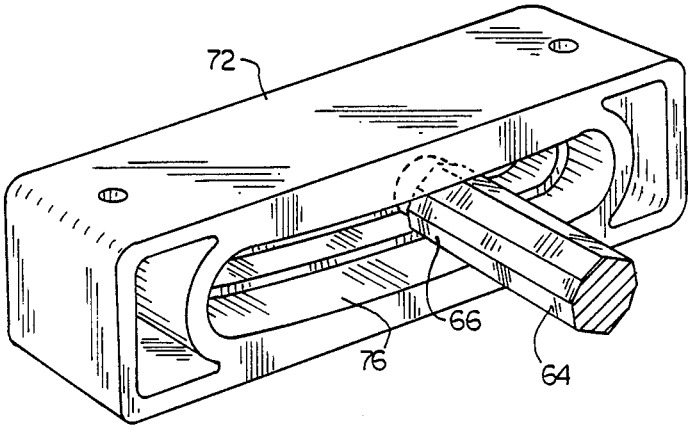
FIG. 7

FIG. 9
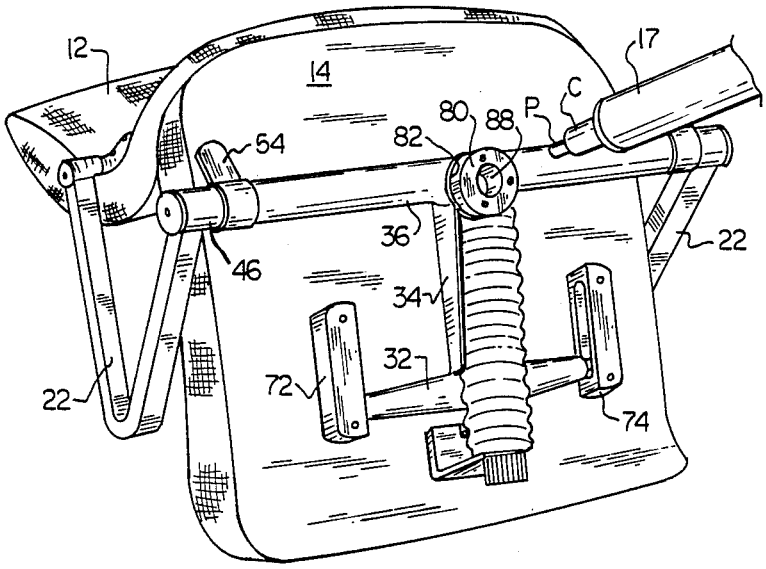
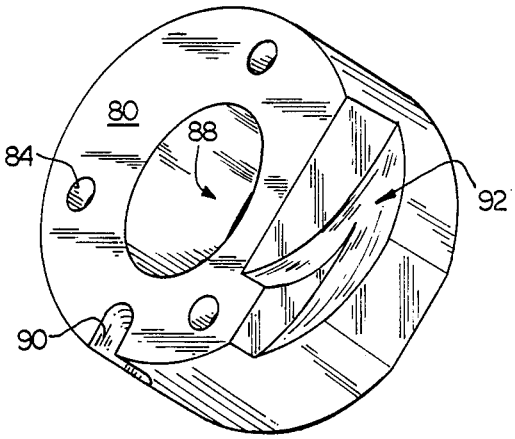
FIG. 9A

OFFICE CHAIR

BACKGROUND AND SUMMARY OF THE PRESENT INVENTION

The present invention is directed to office or executive chairs and more particularly to office chairs which swivel about a vertical column and in which the backrest is articulated to the seat portion so as to be selectively tiltable or reclinable with respect to the seat, which seat synchronously moves forwardly as the backrest tilts rearwardly. The seat may also be raised or lowered by a gas cylinder.

Contemporary chair designers strive for combining the primary characteristics of both esthetics and comfort. As a result various approaches to office or executive chairs have resulted in many different designs. In most designs the seat and back are fixed and tilt together. In other designs the seat is fixed and the back alone tilts. A few designs attempt to achieve a higher degree of comfort by so connecting the seat and backrest that the seat is caused to slide forwardly in a prescribed path responsive to the tilting of the backrest. This is sometimes referred to as "synchronous" seat and back adjustment. The object is to adjust the seat position and inclination automatically as the backrest is tilted to various angles. Once the desired backrest angle is reached the seat and back are locked in position. The goal of the designer is to so reposition the seat responsive to the tilt of the backrest that the maximum comfort level is achieved.

It is another object of the furniture designer, which should not be overlooked, to achieve a pleasing esthetic effect in the furniture while accomplishing his comfort goals. Even further, as a third consideration, the designer is looking for a furniture design which is "manufacturable."

Examples of prior approaches to the "synchronous" seating concept known to the applicants include:

(1) A United States patent to Uneo No. 4,045,081. In the reclining chair described by Uneo, as the upper portion of the backrest is tilted rearwardly, the seat member not only shifts forwardly, but because of the articulated connection between the backrest and seat, the seat, sometimes referred to as the "seat pan," is actually raised after the backrest has pivoted slightly. This results because the articulated connection is forward of the backrest pivot point, and thus as tilting continues, the articulated connection begins to rise. This lifting of the seat pan causes the hips and buttocks of the occupant to tend to slide forwardly, which is not conducive to comfort.

(2) In a British patent to Scott No. GB 2041735, there is described an office chair in which the backrest pivots about an axis located above the seat pan and the seat pan slides forwardly in synchronization with the rearward pivoting of the backrest. Again because of the horizontal relationship between the pivot point and the articulated connection between the seat and backrest, the seat pan tends to rise as it moves forwardly resulting in the aforedescribed uncomfortable effect.

(3) An initial effort to overcome the problem realized by the Uneo and Scott patents described hereinabove is disclosed in a German patent to Vogtherr (one of the joint inventors in the present application), No. DE 3313677. In this patent, an attempt is made to suspend the chair in such a manner that when the backrest is tilted rearwardly, the seat or seat pan actually tends to lower as it slides forwardly. This is believed to provide a more comfortable result. Because of the suspension system disclosed in the Vogtherr patent, the center of gravity of a person remains substantially undisturbed during the tilting of the backrest. While the Vogtherr approach is theoretically sound, there are some practical problems in reducing this theoretical approach to a manufacturable piece of furniture. These problems include the fact that the suspension described in the Vogtherr patent tends to place stress on the support system as the pivot point (and center of gravity of the occupied chair) is horizontally displaced from the point of support by a substantial distance; a relatively strong locking system (approximately 800 newtons) is required to fix the seat in a prescribed inclined position; the esthetic appearance of the area beneath the seat tends to be "cluttered"; and the seat design is not adapted for easily varying the width dimension thereof.

With the aforesaid considerations in mind, the present invention adopts the general concept of synchronous seating as described in the German patent to Vogtherr in which the point of articulation between the backrest and the seat is caused to move downwardly as the backrest is tilted rearwardly. However, the present invention includes changes and additional features which cooperate to overcome the significant manufacturing problems realized by the earlier Vogtherr design. For instance, the support system of the present invention utilizes a unique supporting frame which features a transverse primary support arm aligned with and mounted atop the vertical support column which, in turn, adjustably connects the chair to the base through a gas cylinder. The aforesaid transverse support arm primarily supports the seat and backrest assembly along a transverse support axis substantially underlying the center of gravity of the occupied chair. This provides several advantages. First of all, the stresses on the support system are significantly reduced; the frictional force necessary to lock the chair in a prescribed position is minimized; the simple underneath structural appearance is maintained; and all of the chair controls are incorporated in the transverse support arm and are more easily accessible to the occupant of the chair.

The support frame is provided with a forward cross arm that supports a sliding/locking member in position to operatively engage a pair of laterally spaced, inwardly facing slotted housings in which the sliding-/locking member moves. The sliding/locking member is rotatable between a first sliding position and a second locking position with the opposed slots. The sliding-/locking member is of a non-circular cross section. In the first or sliding position the greater dimension of the sliding/locking member is aligned with the direction of movement, while in the second or locking position the greater dimension of the sliding/locking member is moved into frictional gripping relationship between the walls of the housing forming the slotted opening. While this type of locking system is capable of resisting a dislodging force of only approximately 200 newtons because of the unique suspension system described hereinabove, this is quite adequate to securely lock the chair at a prescribed position.

In order to connect the support frame to the backrest-/seat assembly, the support structure of the present invention further includes a pair of laterally spaced side arms affixed at their lower ends to the opposed ends of the aforementioned transverse support arm. The side arms extend upwardly from the transverse support arm, then rearwardly terminating at a pivotal support point generally adjacent the lumbar region of the backrest. The backrest is pivotally connected between the terminal ends of the side arms at the aforesaid pivotal support point. The backrest is curved from top to bottom and from side to side for purposes to be described hereinafter.

The side arms may take the form of either of two configurations. In the first configuration, the side arms are a full length, in which case each side arm extends upwardly, angling forwardly from the cross arm, then rearwardly to the terminal point. In the second configuration, which is in reality a shortened arm rest for secretaries and typists, the side arms merely extend vertically then rearwardly for a shorter distance.

A separable connector or mounting receptacle is seated within the central portion of the transverse support arm of the support system to receive the upper end of the gas cylinder. The connector serves the purpose of retaining the gas cylinder actuator and the locking linkage in place, while also providing a seat for the rear end of the tension spring tongue. Because of the separable connector, the support frame may be more easily and economically manufactured, since a variety of sizes and shapes of support frames can all be made to utilize the same type of connector.

Another unique feature of the present invention resides in a removable decorative foot cap which snaps into place on the extremity of each leg of the support base. The decorative foot cap allows for easily changing colors, shapes, and for replacing worn or unsightly foot caps.

It is therefore an object of the present invention to provide an improved support structure for office chairs of the type having a synchronous seat and backrest adjustment feature.

Another object of the present invention is to provide a support structure of the type described in which the moment arm between the center of gravity of the occupied seat and the main support member is minimized.

A further object of the present invention is to provide an effective and simple locking technique for use in conjunction with the support system of the type described.

Yet another object of the present invention is to provide a support or suspension system for a chair of the type described and a locking system, which systems are so related that a very slight locking pressure (on the order of 200 newtons) is sufficient to maintain the seat in a stationary position.

Still another object of the present invention is to provide an office chair of the type described in which the backrest is curved from top to bottom and from side to side to maximize the horizontal displacement between the articulated connection and the axis about which the backrest pivots.

Another objectof the present invention is to provide a support system of the type described in which the transverse support member is extendable for use in wider seat configurations.

Finally, an object of the present invention is to provide an office chair of the type described having replaceable decorative foot caps on the legs of the base thereof.

Other objects and a fuller understanding of the invention will become apparent from reading the following detailed description of the preferred embodiment along with the accompanying drawings in which:

FIG. 6 is a perspective view of a portion of the under side of the seat pan of the chair of the present invention illustrating the sliding/locking member in the sliding position with respect to the adjacent housing;

FIG. 7 is a perspective view similar to FIG. 6, except showing the sliding/locking member rotated to the locking position;

FIG. 9 is a perspective view, with parts broken away, illustrating the underneath side of the seat with the vertical support column exploded away;

Figure 10A:
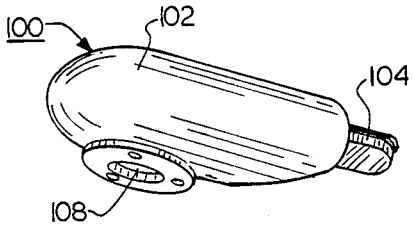
Figure 10B:
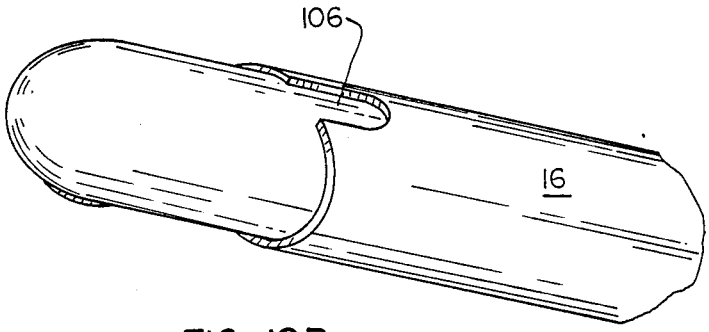

FIG. 9*a* is a perspective view illustrative of a connector for the vertical support column, removed from the support frames;

FIG. 10*a* is a the underside of the foot cap removed from the chair and;

FIG. 10*b* perspective view, broken away, illustrating the terminal end of each leg of the chair base.

DETAILED DESCRIPTION OF A PREFERRED EMBODIMENT

Figure 1:
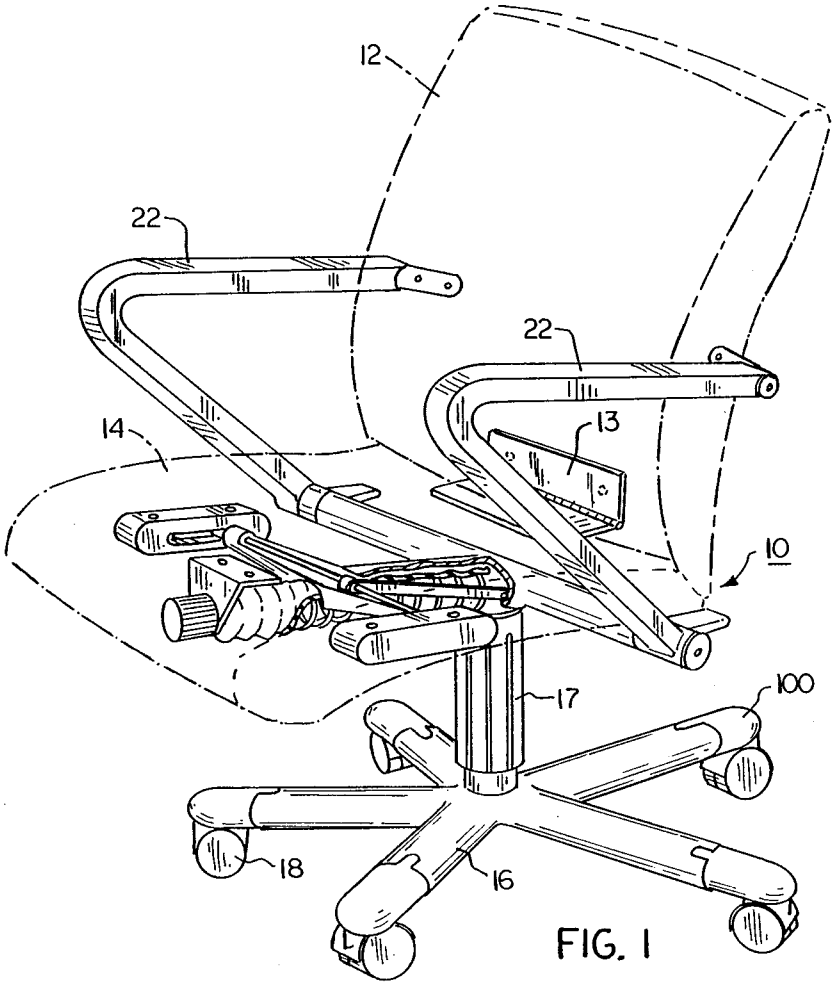
FIG. 1 is a perspective view of the chair according to the present invention.

Turning now to the drawings, there is illustrated in FIG. 1 an office or executive chair which embodies the features of the present invention. The chair includes, in general, a seat assembly 10 including a curved backrest 12 and a seat pan 14 articulated together adjacent the lower edge of the backrest and rear edge of the seat pan. A base structure 16 is formed with a plurality of legs extending radially from a central portion and terminating in support casters 18. An adjustable vertical column 17 extends upwardly from the base 16 and has mounted thereon a support frame 20 underlying the seat 14. A pair of side arms 22 are fixed on the support frame and pivotally support the seat assembly 10.

Figure 2:
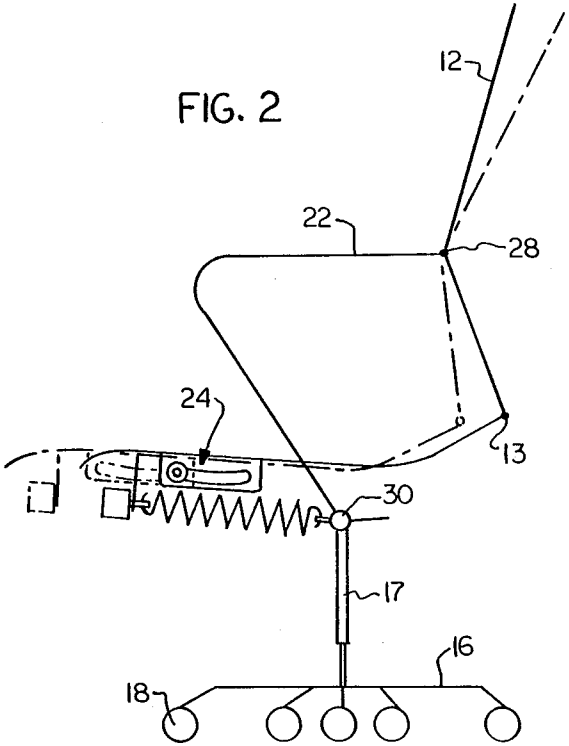
FIG. 2 is a schematic representation of the chair of the present invention illustrative of the relationship between the backrest, seat pan, and support system in both the upright and tilted positions.

The functional operation of the chair may, perhaps, be best understood by referring to the schematic illustration of FIG. 2. As there shown, the backrest 12 and seat pan 14 are supported on the base structure 16 by a support frame or system 20. The backrest 12 includes a lower lumbar region 12*a*, and the backrest 12 and seat pan 14 are articulated together at hinged point 13. Further, the backrest 12 and seat pan 14 are suspended above the support frame 20 by the side arms 22 which are fixed at their lower ends to a transverse support arm 30 which forms the rear portion of the support frame 20. The arms 22 pivotally support the backrest at point 28. Thus the backrest/seat member would normally be free to swing or rotate about point 28, but for a forward connecting means 24 which slidably joins and selectively locks the front portion of the support frame 20 with the front underneath portion of the seat pan 14. When the connector 24 is unlocked, the seat is free to tilt rearwardly responsive to pressure against the upper backrest portion 12. When the connector means 24 is locked, such tilting motion is prohibited. A vertical support column 17 extends upwardly from base 16 and the support frame 20 is attached to the upper end thereof. Support column 17 preferably includes an adjustable gas cylinder.

As can be seen in FIG. 2 the doubling back of arms 22 creates a horizontal support axis 26 which is not far removed horizontally from the center of gravity of the occupied chair, and is somewhat in front of the horizontal axis through the pivot point 28. The positioning of the horizontal support axis at the rear of the support frame 20 substantially beneath the pivot axis 28 accomplishes several desirable results. First of all, the torque moment at the point where the side arms are connected to the support frame 20 is minimized. Secondly, a relatively small locking pressure or force (on the order of 200 newtons) is sufficient to maintain the backrest/seat assembly in the locked position, as the pressures tending to move the seat from the locked position are relatively slight. Thirdly, all of the control features (locking, vertical adjustment, etc.) can be incorporated into the transverse support arm 30 which is very convenient for the occupant.

Figure 3:
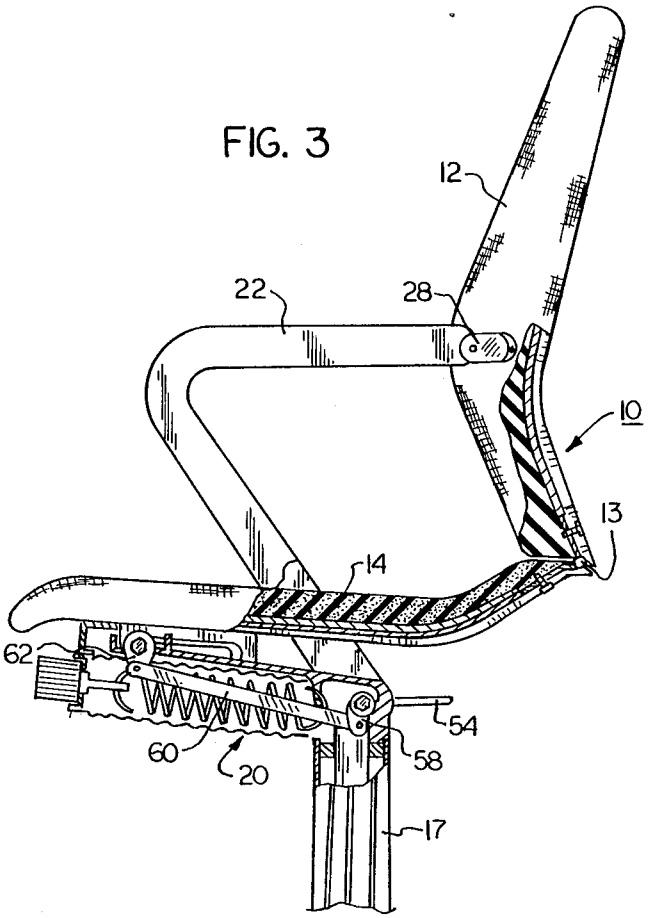
FIG. 3 is a partial side sectional view, with the padding removed illustrating the chair of the present invention in the upright position.
Figure 5:
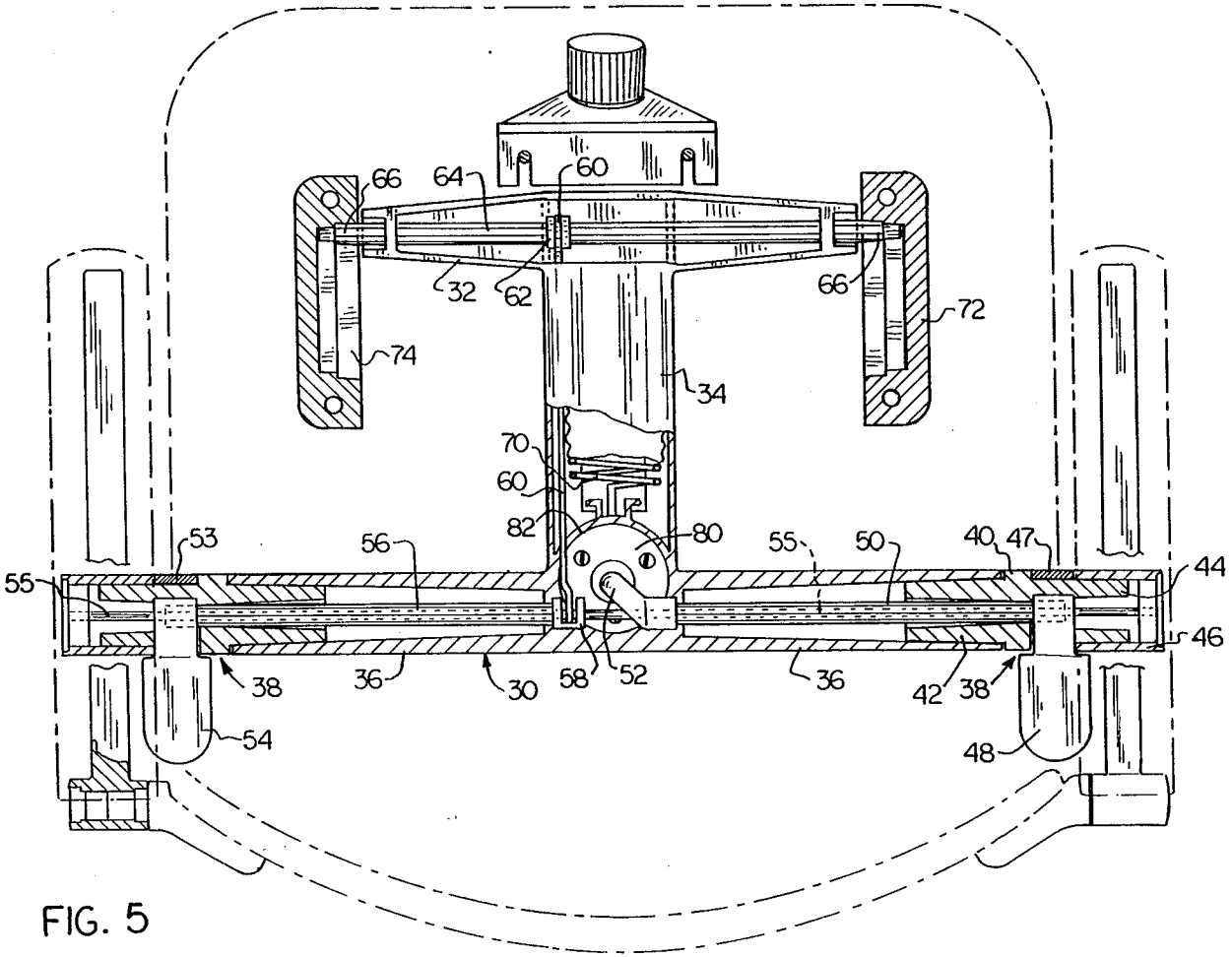
FIG. 5 is a top view of the chair, with the seat shown in dotted lines and the support frame shown in section.
Figure 8:
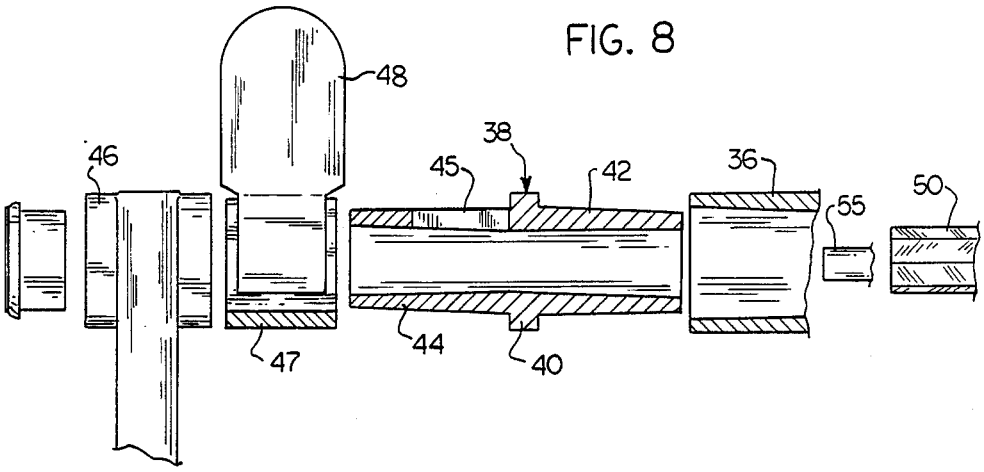
FIG. 8 is an exploded plan view, partially in section, of the support cross arm.

Turning now to FIG. 3, the backrest or back member 12 is illustrated as being curved from top to bottom with the forwardmost portion of the curve being positioned at the pivot point 28 (FIG. 2) and adjacent the lumbar region of the occupant. The backrest 12, as illustrated in FIG. 5 is also curved convexly (looking from the front) from side to side. This results in the maximum displacement between the hinge 13 which articulates the backrest 12 and seat pan 14 and the bearing point 28 where the backrest is attached to side arms 22. The maximum displacement of hinge 13 results in a deeper vertical displacement of the seat pan 14 as the seat is tilted rearwardly (see FIG. 2). This relative movement between the seat pan and the backrest results in the comfort feature desired.

The base 16 includes a plurality of legs 17 extending radially from a center point. A conventional caster 18 supports and is affixed to the free end of each leg 17. The base is a relatively conventional base for an office chair with the exception of the replaceable foot caps 19 which will be described in more detail hereinafter. Base 16 also supports a vertical support column 17 which provides for vertical adjustment of the chair. In this regard, it is envisioned that a conventionally available adjustable gas cylinder assembly is appropriate.

Figure 4:
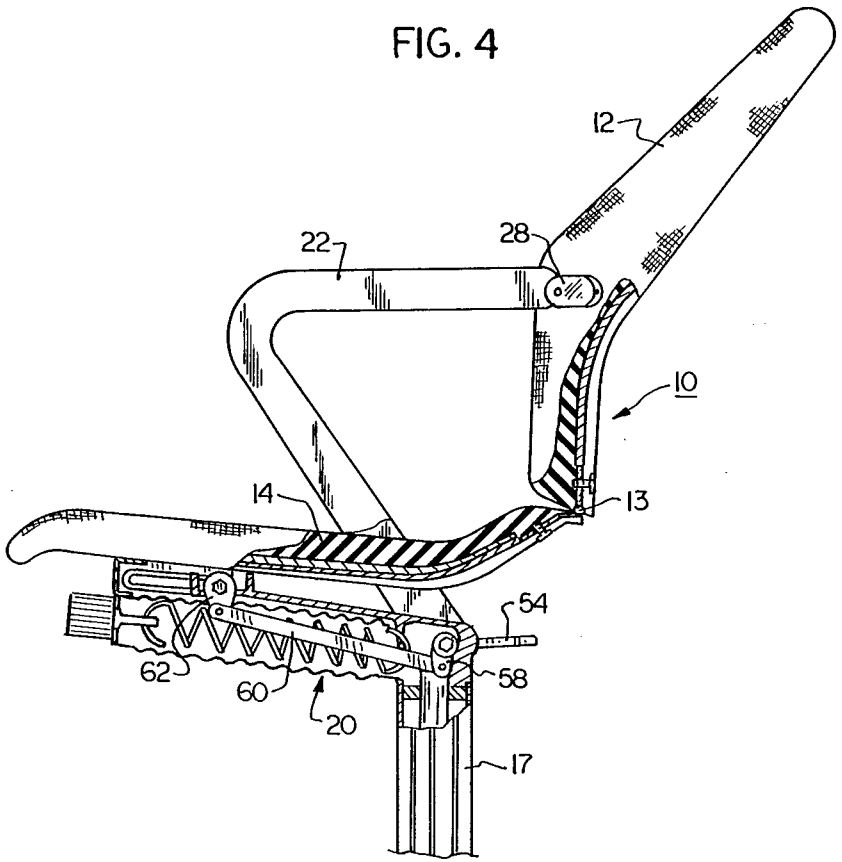
FIG. 4 is a partial side sectional view, similar to FIG. 3, except showing the chair in the tilted position.

In order to connect the seat assembly 10 with the base portion 16, there is provided a support frame 20, best shown in FIGS. 3 through 5. The support frame 20 is mounted on the upper end of the vertical support column 17 and generally is formed by a transverse support arm 30, a shorter cross arm 32, and a main housing 34 connecting the transverse support arm 30 and cross arm 32. The transverse support arm 30 is positioned at the rear of the support frame 20 immediately above the vertical support column 17, while the shorter cross arm 32 extends laterally beneath the front portion of seat pan 14. Both support arm 30 and cross arm 32 are hollow to receive various control components described hereinafter. The transverse support arm 30 forms the sole support for the seat assembly 10 which is connected thereto through arms 22. Toward this end the transverse support arm 30, when fully assembled, is greater in length than the width of seat member 14, so that it protrudes on either side thereof for receiving the side arms 22.

The support arm 30 is hollow and includes a generally tubular portion 36 extending in both directions from the central longitudinal axis of the frame. The hollow interior portion of the tubular members 36 are preferably hexagonal in cross section and tapered as illustrated in FIG. 5 to receive support arm extension connector 38 in each end of tubular portion 36. The extension connectors are also hollow and includes a central portion 40 and a hollow tapered plug extending in either direction axially along the axis of arm 30. The inboard plug portion 42 is shaped so as to complement, be received by, and fit into the hollow tapered interior of tubular member 36. The outwardly facing plug member 44 receives the cylindrical end 46 of side arm 22. The central portion 40 may be of varying lengths, so as to provide for extending the cross arm 30 when used with chairs having seat members 14 of differing widths. Thus if the central member 40 is made one or two inches wider, the cross arm 30 may accommodate a seat two to four inches wider.

A cover ring 47 is mounted to plug portion 44 between the central portion 40 and the cylindrical end 46 of side arm 22. A first lever handle 48 extends through the cover ring 47 and a corresponding opening 45 in plug 44 and receives one end of a tubular activating rod 50. A central bore in the central portion 40 of extension connector 38 supports the rod 50 centrally of cross arm 30. The tubular activating rod 50 connects the lever 48 to an activating lug 52 positioned immediately above the plunger (FIG. 3) of the gas spring in vertical column 17. In the normal retracted position, the lever 52 is out of engagement with the gas spring plunger; however, when the lever actuating handle 48 is rotated by the occupant to an activating position, the lug 52 is depressed into operative engagement with the plunger of the gas cylinder so that the height of the chair can be readjusted. It should be here noted that the activating rod 50 is also hollow to receive a connecting rod 51 which extends entirely through the transverse support rod to maintain all of the aforementioned components in assembled relation thereon.

A second lever handle 54 is attached through a similar cover ring 53 to a second tubular activating rod 56 on the opposite side of support arm 30 for activating the locking mechanism as will be hereinafter described. For the present time, it will suffice to indicate that the lever handle 54 is also rotatably mounted on the transverse support arm 30. Tubular rod 56 connects the operating lever handle 54 with the rear crank 58 of a linkage which, in turn will pass through the main housing 34. A linkage arm 60 connects the rear crank 58 with a front or forward crank 62. The front crank 62 is operatively secured to the operating rod 64 of a sliding/locking member 66 hereinafter referred to as a "slide bearing." The function of the slide bearing 66 will be better described hereinafter with reference to a description of FIGS. 6 and 7. However, for the moment it will suffice to say that a rotation of the lever handle 54 causes the linkage 58,60,62 to rotate the operating rod 64 and the slide bearing 66 through a prescribed arc. A tension spring 70 is also housed in the main housing 34 of support frame 20, however, the linkage arm 60 is positioned close to the wall of housing 34, so that no interference between the linkage arm 60 and the spring 70 is realized. Spring 70 connects the stationary support frame 20 to the slidable seat 14 to adjust the force normally tending to retain the backrest 12 in the upright position. This is a well-known technique and no further explanation of the function of spring 70 is deemed necessary.

Turning now to FIGS. 6 and 7, there is illustrated the connecting means which slidably joins and selectively locks the cross arm 32 of support frame 20 with the front portion of the seat member. A pair of spaced slotted housings 72,74 are affixed to the underneath of surface seat member 14. Each housing 72,74 includes an inwardly facing longitudinal slot or track 76 therein facing the adjacent extremity, and thus the slide bearing 66, of the cross arm 32. By way of illustration, the slide bearing 66 is shown as being hexagonally-shaped. The diameter between the flats of the hexagonally-shaped member is approximately equal or slightly less than the width of slot or track 76. Thus, when the hexagonally-shaped slide bearing 66 is positioned in a first sliding position with the flats parallel to the walls of track 76, the slide bearing permits movement of the housing relative to cross arm 32. However, when the slide bearing 66 is turned 30° responsive to activation of lever handle 54, the effective diameter of the sliding/locking member is greater than the distance between the walls forming the track 76. In such position then, the greater diameter effectively and frictionally engages the side walls of slot 76 to lock the bearing 66 in place, thus preventing sliding of the seat and tilting of the backrest in either direction. Because of the suspension system described hereinabove, the frictional force necessary to prevent movement of the chair in either direction is relatively small (on the order of 200 newtons (as compared with 800 newtons in other types of chairs). While the slide bearing 66 is illustrated as a hexagonally-shaped member, any non-circular shape will suffice, so long as the member has a greater effective diameter when turned to a first position than the effective diameter in a second position. Thus the slide bearing 66 could theoretically be octagonal, rectangular, or eliptical in shape. However, it is felt that the hexagonal shape is a good compromise, since it provides a greater effective diameter difference than is the case with polygons of a greater number of size, yet requires only a 30° movement of lever handle 54 to effect such locking movement.

As previously described, a connector or receptacle 80 is seated in a recess 82 of support frame 20 at the point of intersection between transverse support arm 30 and main housing 34. Recess 82 is generally a cupshaped seat on the underside of frame 20. The receptacle 80 includes three peripherally spaced openings or passageways 84 which receive fasteners 86 therethrough to secure the receptacle within the seat 82. FIG. 9*a* is illustrative of the upper portion of receptacle 80 which is normally seated in recess 82. Receptacle 80 includes a relatively large central opening 88 through which the upper end of the gas cylinder C extends and is received. It should be noted that the plunger P of the gas cylinder extends through and upwardly above the top surface of the receptacle 80, so that it may be easily accessed and activated by the activating lever 52. The receptacle 80 also includes a recess 90 in the upper portion of the side wall of receptacle 80 which faces longitudinally toward the axis of the main housing. The purpose of the recess 90 is to allow the end finger of the tension spring 70 to pass therethrough and be secured behind a downwardly extending flange or abutment 35 in the main housing 34. The side of the receptacle 80 facing the linkage 58,60, is cut away to form a seat 92 for providing clearance for the operation of rear crank member 58. As the hollow tubes 50,56 engage the peripheral surface of receptacle 80, movement inwardly is prevented.

Since the receptacle or mounting connector 80 is separate from frame 20, several desirable results are obtained. First of all, all frames are more easily compatible with gas cylinders. Secondly, the receptacle 80 includes several rather complicated passageways, seats, and recessed surfaces. Therefore, it is much easier to fabricate and machine the receptacle 80 as a smaller separate piece, rather than as a part of the casting for the entire support frame 20. The receptacle, in addition to receiving and connecting the frame to the gas cylinder, also provides a mount for the tension spring rear tongue; holds the gas spring actuator 52 and the locking actuator or rear crank 58 in place.

A decorative foot cap 100 is releasably attached to the end of each leg 16 of the base. The foot cap 100 is a molded, flexible, polymeric material which includes a body portion 102 and a longitudinally extending finger 104 which extends for a short distance along the surface of the leg 16. Finger 104 is received into a seat 106 on the leg member 16. The underside of the foot cap includes an opening 108 therein through which the attachment post of the caster extends to secure the foot cap in place. The foot cap 100 is emplaced by merely flexing it and sliding it onto the extremity of the foot 16 with the caster removed until the tongue 104 is emplaced within seat 106. When the caster is emplaced through opening 108, the foot cap is securely in place. The foot cap 100 may be removed by the opposite procedure. The decorative foot cap provides a protective function for the end of the legs 16 which tend to become scarred or unsightly from use in conventional furniture configurations. Since the foot cap may be easily assembled and removed, the chair may be made to look refurbished by merely replacing the foot caps 100. Also, the appearance of the chair may be changed by providing foot caps of various colors and/or shapes.

As illustrated in FIGS. 3 and 4, the side arms 22, in one embodiment, may be full length, in which case they extend forwardly and upwardly from the lower point, then rearwardly to the point of attachment 28 with the backrest. In another embodiment for secretarial or clerical purposes, it may be desirable to have a shorter arm configuration. In such case, the arm 22' (FIG. 4) extends vertically upwardly, then rearwardly for a shorter distance to the point of attachment with backrest 12.

Referring again to FIG. 2, in order to support the seat 10 from the support frame 20 with minimum torque or moment exerted at the point of attachment 26, it is preferable to maintain a prescribed relationship between three transverse axes, i.e. a first transverse or horizontal axis extending along the rear edge of said seat member and the lower edge of said back member at the point where said seat member and back member are hingedly articulated together; a second horizontal axis extending through the lumbar region at the point where the rear end of the arms are pivotally attached to the backrest 12; and a third horizontal axis coincident with the transverse support arm. The second horizontal axis through the lumbar region lies rearwardly of the third axis coincident to the transverse support arm 30. The first transverse or horizontal axis is movable responsive to tilting of the back member between a first upright position in which the first horizontal axis is positioned substantially rearward of said horizontal axis, and a second tilted position in which said first horizontal axis is positioned closer to or even substantially beneath said second horizontal axis. It is important to note that the chair should be so designed so that the first horizontal axis does not move forwardly of a position beneath the second horizontal axis. In such case, the seat portion would then be lifting responsive to further tilting of the backrest, which would be defeating one of the main purposes of the present invention. As shown and described, however, as the back member is tilted rearwardly, the seat member realizes a slight lowering.

While the relationship between the first and second horizontal axes are described in the earlier German patent to Vogtherr, the positioning of the third horizontal axis is unique to the present invention. Further, because of the unique manner in which the chair is suspended from the cross arm 30 (third horizontal axis) and the relative positioning between the cross arm 30 and the first and second horizontal axes, the horizontal distance between the center of gravity of the occupied chair and the transverse support arm is minimized. A second advantage of the relative positioning of the first, second, and third horizontal axes is the resulting minimal locking pressure necessary to fix the chair in the locked position and prevent sliding thereof as compared with prior art arrangements.

While the chair of the present invention has been described in detail hereinabove, it is apparent that various changes and modifications might be made without departing from the scope of the present invention, which is set forth in the following claims.

What is claimed is:

1. An office chair comprising:

(a) a seat member and a backrest member having a lumbar region, said seat member and backrest member hingedly articulated together about a first horizontal axis extending along the rear of said seat member and the lower edge of said backrest member, said backrest member being curved from top to bottom about a second horizontal axis extending through said lumbar region;

(b) a support system including:

(i) a vertical column extending upwardly from a base and a support frame having a transverse support arm;

(ii) said transverse support arm mounted on the upper end of and extending perpendicularly from said vertical column, said transverse support arm extending beneath said seat member along a third horizontal axis;

(iii) said support frame further including a front member and a longitudinal member extending forwardly from said transverse support arm;

(c) a pair of side arms, each side arm affixed to an opposite end of said transverse support arm and extending upwardly then rearwardly therefrom, the upper end of each side arm pivotally supporting opposite side edges of said backrest member at a point substantially aligned with said second horizontal axis;

(d) spaced slotted housing secured to the undersurface of said seat member adjacent the front portion thereof;

(e) connecting means slidably joining and selectively locking said front member of said support frame within said spaced slotted housings;

(f) the second horizontal axis extending through said lumbar region lying rearwardly of said transverse support arm, said first horizontal axis being movable responsive to tilting of said backrest member between a first upright position in which said first horizontal axis is positioned substantially rearwardly of said second horizontal axis and a second tilted position in which said first horizontal axis is positioned substantially beneath said second horizontal axis;

(g) whereby as said back member is tilted rearwardly said seat member realizes a slight lowering and the horizontal distance between the center of gravity of the occupied chair and said transverse support arm is minimized.

2. The office chair according to claim 1 wherein said connecting means comprises:

(a) a cross arm forming said front end of said support frame and extending transversely thereto in both directions therefrom;

(b) said slotted housing including an inwardly facing, longitudinal slot therein;

(c) a shaft extending through said cross arm and terminating in a slide bearing on either end thereof, said slide bearing protruding from said cross arm into seated relationship with said longitudinal slot in said slotted housing, said slide bearing being rotatable between a first sliding position and a second locking position, the effective diameter of said slide bearing between the walls forming said slot being greater in said second locking position than in said first sliding position.

3. The office chair according to claim 2 wherein said effective diameter of said slide bearing is such in said second position that a frictional locking force of substantially 200 newtons is exerted.

4. The office chair according to claim 2 and further including a linkage means connecting said transverse support arm and said shaft extending through said cross arm for relating said slide bearing between said first and said second positions.

5. The office chair according to claim 4 further including a locking handle pivotally supported on said transverse support arm, said linkage means being activated responsive to movement of said locking handle.

6. The office chair according to claim 5 wherein said linkage means extends through said transverse support arm and said cross arm and operatively connects said locking handle and said slide bearing.

7. The office chair according to claim 2 wherein the cross sectional shape of said slide bearing is hexagonal.

8. The office chair according to claim 1 wherein said backrest member is curved from side to side in addition to being curved from top to bottom, whereby the horizontal distance between said first horizontal axis and said second horizontal axis is maximized to provide a greater downward displacement of the seat portion of the chair responsive to the tilting of the backrest.

9. The office chair according to claim 1 wherein said transverse support arm includes a support arm extension connector affixed to each end thereof, said extension connector including a first hollow tapered plug extending into said support arm and a second hollow tapered plug extending in the opposite direction, each said side arm being attached to one of said second hollow tapered plugs, whereby the length of said cross member may be extended by using extension connectors of varying lengths to provide for wider or narrower seating configurations.

10. The office chair according to claim 1 wherein said vertical column comprises a gas cylinder having an activating plunger at the upper end thereof extending into said support frame at approximately the intersection of said transverse support arm and said main housing, an activating lever carried within said transverse support arm and being movable between a first retracted position and a second position in operative engagement with said plunger, and a height adjustment lever handle mounted on said transverse support arm connected to said activating lever by a first activator rod for moving said activating lever between said retracted and said operative positions.

11. The office chair according to claim 10 wherein said chair further includes a linkage means connecting said transverse support arm and said shaft extending through said cross arm for rotating said slide bearing, a locking lever handle pivotally mounted on said transverse support arm and connected to said linkage means internally of said transverse support arm by a second activating rod; and further including a mounting receptacle releasably seated in a recess in said support frame at the point where said support frame mounts on the upper end of said vertical column, said mounting receptacle having an opening therethrough for receiving and mounting the support frame on the upper end of said gas cylinder, said mounting receptacle further including abutment surfaces for engaging and retaining said first activating rod and said second activating rod in position.

12. The office chair according to claim 1 and further including a base for supporting said vertical column, said support base comprising a plurality of radially extending legs, each terminating at a free end and including a caster releasably attached to the underside thereof, a decorative foot cap releasably attached to the free end of said leg member and including an opening in the underside thereof through which said caster extends to hold said foot cap in position.

* * * * *